US011420351B2

(12) United States Patent
Paspatis et al.

(10) Patent No.: US 11,420,351 B2
(45) Date of Patent: Aug. 23, 2022

(54) ADJUSTABLE SHAVING BLADE ASSEMBLY

(71) Applicant: BIC Violex S.A., Anoixi (GR)

(72) Inventors: Georgios Paspatis, Athens (GR); Vasileios Stamoulis, Trikala (GR)

(73) Assignee: BIC Violex Single Member S.A., Anoixi (GR)

( * ) Notice: Subject to any disclaimer, the term of this patent is extended or adjusted under 35 U.S.C. 154(b) by 1 day.

(21) Appl. No.: 16/973,019

(22) PCT Filed: Jul. 5, 2019

(86) PCT No.: PCT/EP2019/068108

§ 371 (c)(1),
(2) Date: Dec. 7, 2020

(87) PCT Pub. No.: WO2020/008037

PCT Pub. Date: Jan. 9, 2020

(65) Prior Publication Data

US 2021/0245377 A1 Aug. 12, 2021

(30) Foreign Application Priority Data

Jul. 5, 2018 (EP) ..... 18181953

(51) Int. Cl.
*B26B 21/22* (2006.01)
*B26B 21/40* (2006.01)

(52) U.S. Cl.
CPC ..... *B26B 21/227* (2013.01); *B26B 21/4062* (2013.01)

(58) Field of Classification Search
None
See application file for complete search history.

(56) References Cited

U.S. PATENT DOCUMENTS 2,711,014 A * 6/1955 Abraham ..... B26B 21/12 30/31
3,667,121 A 6/1972 Dorion, Jr. et al.
4,345,374 A 8/1982 Jacobson
4,993,154 A * 2/1991 Radcliffe ..... B26B 21/521 30/32

(Continued)

FOREIGN PATENT DOCUMENTS

DE 162004020650 A1 11/2005
DE 102010022606 A1 12/2011

(Continued)

OTHER PUBLICATIONS

International Search Report and Written Opinion dated Apr. 17, 2020, in International Patent Application No. PCT/EP2019/068108 (11 pages).

*Primary Examiner* — Hwei-Siu C Payer
(74) *Attorney, Agent, or Firm* — Bookoff McAndrews, PLLC

(57) ABSTRACT

A shaving blade assembly is provided. The shaving blade assembly comprises a blade, one or more blade retainers, a first resilient element pressing the blade against the blade retainer in a first direction along a first axis that is orthogonal to a cutting edge of the blade, and a first rack-and-pinion mechanism with a rack operationally coupled to the first resilient element and a pinion for actuating a motion of the rack along the first axis.

15 Claims, 4 Drawing Sheets

(56) References Cited

U.S. PATENT DOCUMENTS

| | | | | |
|---|---|---|---|---|
| 5,199,173 | A * | 4/1993 | Hegemann | B26B 21/225 30/531 |
| 5,224,267 | A * | 7/1993 | Simms | B26B 21/4068 30/527 |
| 5,313,706 | A | 5/1994 | Motta et al. | |
| 6,173,498 | B1 | 1/2001 | Warrick et al. | |
| 7,367,125 | B2 * | 5/2008 | Aviza | B26B 21/443 30/79 |
| 2016/0346944 | A1 | 12/2016 | Sadrialaei | |
| 2020/0346357 | A1 * | 11/2020 | Skodras | B26B 21/225 |
| 2020/0346359 | A1 * | 11/2020 | Saltas | B26B 21/4025 |
| 2020/0353633 | A1 * | 11/2020 | Athanassiou | B26B 21/4062 |
| 2021/0245377 | A1 * | 8/2021 | Paspatis | B26B 21/4062 |

FOREIGN PATENT DOCUMENTS

| | | | |
|---|---|---|---|
| WO | 0139937 | A1 | 6/2001 |
| WO | 2012070038 | A1 | 5/2012 |

* cited by examiner

ADJUSTABLE SHAVING BLADE ASSEMBLY

This application is a National Stage Application of International Application No. PCT/EP2019/068108, filed on Jul. 5, 2019, now published as WO/2020/008037 and which claims priority to European patent application EP 18181953.3 filed on Jul. 5, 2018, entitled "ADJUSTABLE SHAVING BLADE ASSEMBLY".

The disclosure relates to shaving blade assemblies and to razors comprising such shaving blade assemblies for shaving, for instance, facial, head and/or body hair. Methods for adjusting pressure on the blades of such assemblies are also disclosed.

BACKGROUND

According to the personal preference, hair growth and/or anatomy of razor users, they may desire to shave more or less boldly. By "bold", one should understand shaving wherein the cutting edge of each shaving blade is pressed with a stronger pressure and/or angle of attack against the user's skin, thus cutting the protruding hairs closer to the skin. The same user may even prefer or require bolder shaving of certain areas, and more sensitive, that is, less bold, shaving of others.

Shaving heads or blade units comprising a plurality of blades with adjustable exposure mechanisms are already commonly known in the art. For example, U.S. Patent Application Publication US 2016/0346944 A1 disclosed shaving blade assemblies with blades that can be pivoted around axes parallel to their cutting edges. Similar pivoting blade arrangements were disclosed in U.S. Pat. Nos. 5,313,706 and 4,345,374. Such pivoting blade arrangements present however some drawbacks: firstly, the pivoting blades cannot be individually sprung, and secondly, pivoting the blades towards the shaving plane to obtain more sensitive shaving simultaneously narrows the space between adjacent parallel blades, which decreases the shaving efficacy, while rendering cleaning more difficult.

SUMMARY

According to aspects of the present disclosure, a shaving blade assembly may comprise a blade, one or more blade retainers, and a first resilient element pressing the blade against the blade retainers in a first direction along a first axis that is substantially orthogonal to a cutting edge of the blade. According to these aspects, the shaving blade assembly may further comprise a first rack-and-pinion mechanism with a rack operationally coupled to the first resilient element and a pinion for actuating a motion of the rack along the first axis. Such a rack-and-pinion mechanism can thus adjust the pressure exerted by the first resilient element on the blade, so that pliancy of the blades can be adjusted in a highly precise manner, to obtain a bolder or more sensitive shave.

According to at least one aspect, the blade retainers may be resilient so as to act as counter-springs to the first resilient element. The blade exposure may thus be further adjusted or controlled through a resilient deformation of the blade retainers.

According to at least one aspect, the first rack-and-pinion mechanism may comprise an end stop for limiting travel of the rack in the first direction of the first axis. The end stop can thus prevent or at least reduce overstressing the first resilient element or the first rack-and-pinion mechanism by e.g. driving the rack too far in the first direction against the blade retainer. Another end stop may eventually limit the travel of the rack in the opposite direction, for instance to prevent that the rack comes out of engagement with the pinion.

According to at least one aspect, the shaving blade assembly may further comprise a detent mechanism for releasably holding the rack in at least one position along the first axis. In some examples according to this aspect, the shaving blade assembly may further comprise a housing, and the detent mechanism may be arranged between the housing and the rack or pinion of the first rack-and-pinion mechanism. In particular, in some of these examples, the pinion may be rotatably coupled with a rotatable shaft and the detent mechanism be arranged between the housing and the rotatable shaft. Such a detent mechanism may provide for the possibility to stop and hold the rack in one or more well-defined positions, each corresponding to a degree of shaving boldness.

According to at least one aspect, the first resilient element and the rack of the first rack-and-pinion mechanism may be integrally formed as a monoblock part. This can provide for a simple construction and cost-effective assembly process.

According to at least one aspect, the cutting edge of the blade may extend from a first end of the blade to a second end of the blade, the first resilient element may be adjacent to the first end of the blade, and the shaving blade assembly may further comprise a second resilient element, adjacent to the second end of the blade and also pressing the blade against the blade retainer in the first direction of the first axis. A second rack-and-pinion mechanism may further be provided, with a rack operationally coupled to the second resilient element and a pinion to actuate a motion of the rack of the second rack-and-pinion mechanism along the first axis. In some examples according to this aspect, the pinion of the first rack-and-pinion mechanism and the pinion of the second rack-and-pinion mechanism may be rotatably coupled to a rotatable shaft. Such twin, eventually coupled rack-and-pinion mechanisms at the two ends of the blade may ensure or at least contribute to providing substantially equal compression or release of both first and second resilient elements.

According to at least one aspect, the blade may be a plurality of parallel blades of the shaving blade assembly, and the first axis may be perpendicular to a plane defined by cutting edges of the plurality of blades. Including a plurality of blades in the shaving blade assembly allows for a cleaner, and/or faster shave.

According to at least one aspect, the shaving blade assembly may further comprise a releasable connector for connecting the shaving blade assembly to a razor handle, thus forming an exchangeable blade cartridge of a razor comprising this shaving blade assembly and the razor handle when connected to the releasable connector of the shaving blade assembly. Alternatively, a disposable razor may comprise a shaving blade assembly as previously described and an integrally formed with a razor handle.

In at least another aspect, a method for adjusting pressure on a blade of a shaving blade assembly in a first direction of a first axis orthogonal to a cutting edge of the blade is disclosed. The method may comprise a step of rotating a pinion of a first rack-and-pinion mechanism to actuate a motion, along the first axis, of a rack of the first rack-and-pinion mechanism, wherein the first rack-and-pinion mechanism may be operationally coupled to a first resilient element that may press the blade against one or more blade retainers in the first direction of the first axis.

The above summary of some aspects of the present disclosure is not intended to describe each disclosed implementation. In particular, selected features of any illustrative example within this specification may be incorporated into an additional example unless clearly stated to the contrary.

BRIEF DESCRIPTION OF THE DRAWINGS

The present disclosure may be more completely understood in consideration of the following detailed description of examples in connection with the accompanying drawings, in which.

Figure 1:
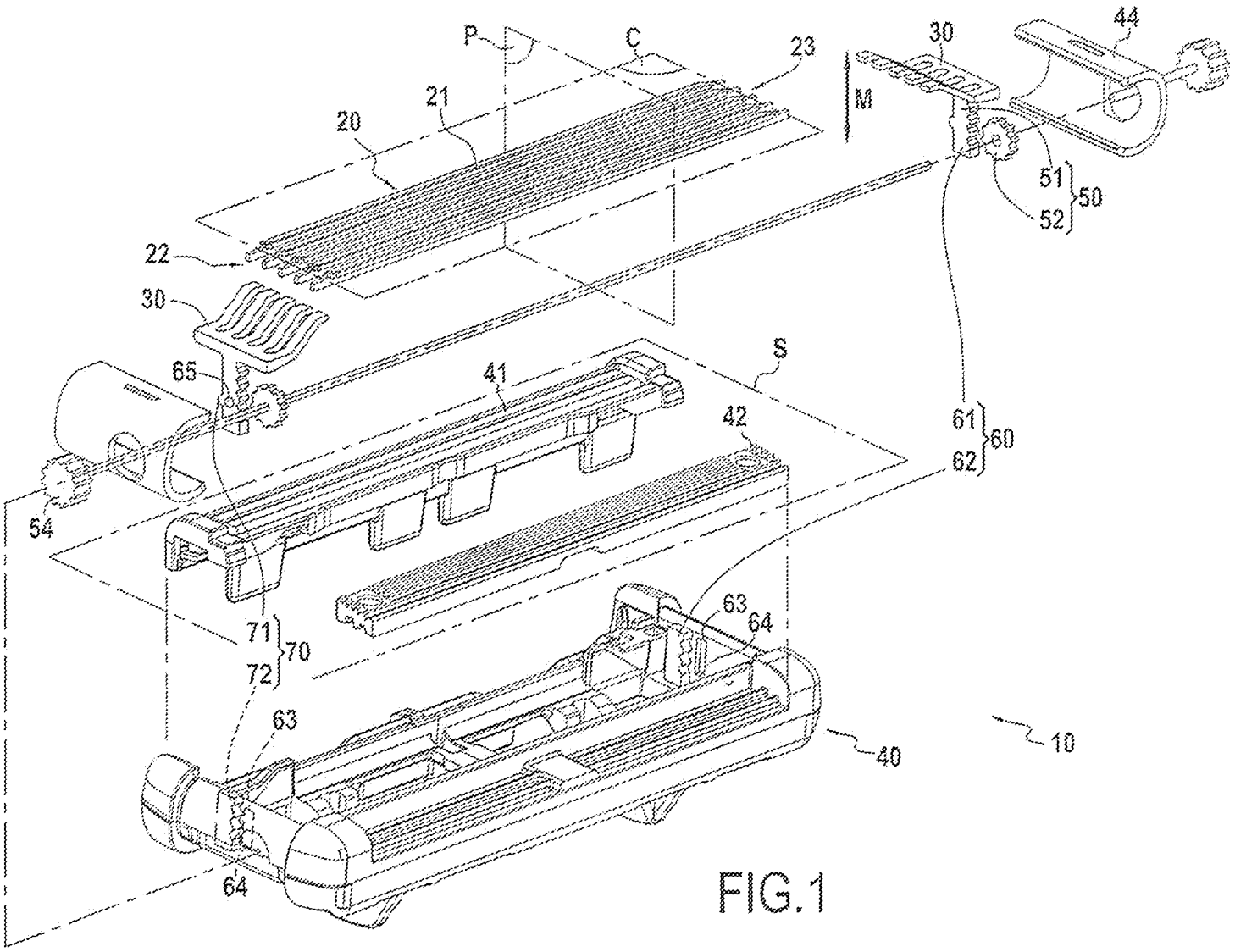
FIG. 1 is an exploded perspective view of a shaving blade assembly according to an example.

While the disclosure is amenable to various modifications and alternative forms, specifics thereof have been shown by way of example in the drawings and will be described in detail. It should be understood, however, that the intention is not to limit aspects to the particular embodiments described. On the contrary, the intention is to cover all modifications, equivalents, and alternatives falling within the scope of a fair reading of appended claims.

DETAILED DESCRIPTION OF EXAMPLES

For the following defined terms, these definitions shall be applied, unless a different definition is given in the claims or elsewhere in this specification.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative examples and are not intended to limit the scope of the present disclosure. The illustrative embodiments depicted are intended only as exemplary. Selected features of any illustrative embodiment may be incorporated into an additional embodiment unless clearly stated to the contrary.

FIG. 1 illustrates schematically a shaving blade assembly 10 comprising a plurality of parallel blades 20, each one of them with an exposed cutting edge 21 for shaving. The blades 20 may be held within a housing 40 and offset from each other perpendicularly to their cutting edges 21, which define together a plane C. Each blade 20 may extend longitudinally along its cutting edge 21 from a first end 22 to a second end 23 of the blade 20.

As illustrated, the blades 20 may be inclined with respect to the plane C defined by their cutting edges 21. Although, as in the illustrated example embodiment the shaving blade assembly 10 may comprise a plurality of parallel blades 20, any number of blades 20, including a single one, may be considered according to the circumstances.

A front face of the housing 40 may define a shaving plane S. For instance, as shown on FIG. 1, the housing 40 may comprise a lubricant strip 41 and/or a guard bar 42 disposed on the front face, and the shaving plane S may be tangent to top surfaces of the lubricant strip 41 and guard bar 42.

In examples, the guard bar may comprise fins, recesses and/or protrusions. The lubricant strip 41 and/or finned guard bar 42 may be configured to further improve the shaving feel. The term "exposure" as used herein is intended to mean the distance from each cutting edge 21 of a blade 20 to the shaving plane S, perpendicularly to the shaving plane S. Blade exposure is typically considered positive when the blade edge 21 protrudes out of the housing 40 beyond the shaving plane S and is considered negative when the blade edge 21 is retracted into the housing 40 behind the shaving plane S, at rest position.

The housing 40 may further comprise a blade retainer 44, and in particular a blade retainer 44 at each end of the housing 40 in the direction of the cutting edges 21 of the blades 20. These blade retainers 44 may be configured to contact each blade 20 to retain it within the housing 40. As shown, the blade retainers may present a substantially C-shaped cross section, and may present some resilience against deformation along a first axis M. In alternatives, the blade retainers may have other cross sectional shapes such as e.g. U-shape.

As illustrated, each blade 20 may be individually sprung within a housing 40 of the shaving blade assembly 10. More specifically, the shaving blade assembly 10 may comprise within the housing 40, adjacent to each end 22, 23 of each blade 20, a resilient element 30, which may take the form of a spring finger, as shown in FIG. 1, pressing the respective blade 20, in a first direction along a first axis M, against the blade retainers 44. This first axis M may be orthogonal to the cutting edges 21 of the blades 20, and may thus be any axis in a plane P perpendicular to the cutting edges 21. In particular, the first axis M may be perpendicular to the plane C, as shown in FIG. 1. The abovementioned first direction along the first axis M may be directed towards the outside of the shaving blade assembly 10, so that the resilient element 30 provides a return force against pressure exerted on the cutting edge 21 of the blade 20, along the first axis M, during shaving. Decreasing the pliancy of the resilient element 30 may thus provide for a bolder shave, whereas increasing the pliancy may provide for a more sensitive shave. Moreover, each blade retainer 44 may act as a counter-spring to these resilient elements 30 so that increasing the pressure exerted by the resilient elements 30 in the first direction along the first axis M may resiliently deform the blade retainers 44 to increase blade exposure, whereas decreasing that pressure may allow the blade retainers 44 to spring back and decrease blade exposure, so as to obtain more or less bold shaving.

The shaving blade assembly 10 may further comprise at least one rack-and-pinion mechanism 50 arranged at one or both longitudinal ends of the housing 40, adjacent to the first and/or second ends 22, 23 of the blades 20, as shown in FIG. 1. More specifically, each rack-and-pinion mechanism 50 may comprise a pinion 52 and a rack 51, oriented along the first axis M, and in engagement with the pinion 52. A guide 60 oriented along the first axis M may guide the movement of the rack 51, with respect to the housing 40, along the first axis M. As in the example shown in FIG. 1, the guide 60 may be formed by a rear surface 61 of the rack 51 of each rack-and-pinion mechanism 50 and an opposite guiding surface 62 in the housing 40 engaging the rear surface 61. The housing 40 may further comprise end stops 63, 64 for engaging a protrusion 65 of the rack 51 to limit the travel of the rack 51 in either direction along the first axis M, in particular in the first direction to prevent or at least reduce overstressing the resilient elements 30 against the blades 20 and blade retainers 44. As shown in FIG. 1, the resilient elements 30 at each longitudinal end of the housing 40 may be jointly coupled to the rack 51 of the corresponding rack-and-pinion mechanism 50. More specifically, if the resilient elements 30 are in the form of spring fingers, as shown, the resilient elements 30 may be joined at a joint end 31 opposite to the ends of the spring fingers contacting the blades 20 and may be coupled to the rack 51 at that joint end 31. In particular, the resilient elements 30 and the rack 51 may be integrally formed as a monoblock part, for instance by injection molding.

As illustrated in FIG. 1, in each rack-and-pinion mechanism 50 a rotatable shaft 53 may rotationally couple the pinion 52 to a dial wheel 54, at least partially exposed outside the housing 40, for manually operating the rack-and-pinion mechanism 50 through the dial wheel 54. As also illustrated in FIG. 1, this rotatable shaft 53 may also extend between the rack-and-pinion mechanisms 50 at each longitudinal end of the housing 40 so as to couple their respective movements. The skilled person can also understand that, although the illustrated example includes a dial wheel 54 for each rack-and-pinion mechanism 50, if the two rack-and-pinion mechanisms 50 are coupled through the rotatable shaft 53, a single dial wheel 54 may be used to operate both rack-and-pinion mechanisms 50 simultaneously. Each dial wheel 54 may comprise indices, for instance color-coded and/or numbered indices, to indicate the position of the corresponding rack-and-pinion mechanism 50.

Figure 2:
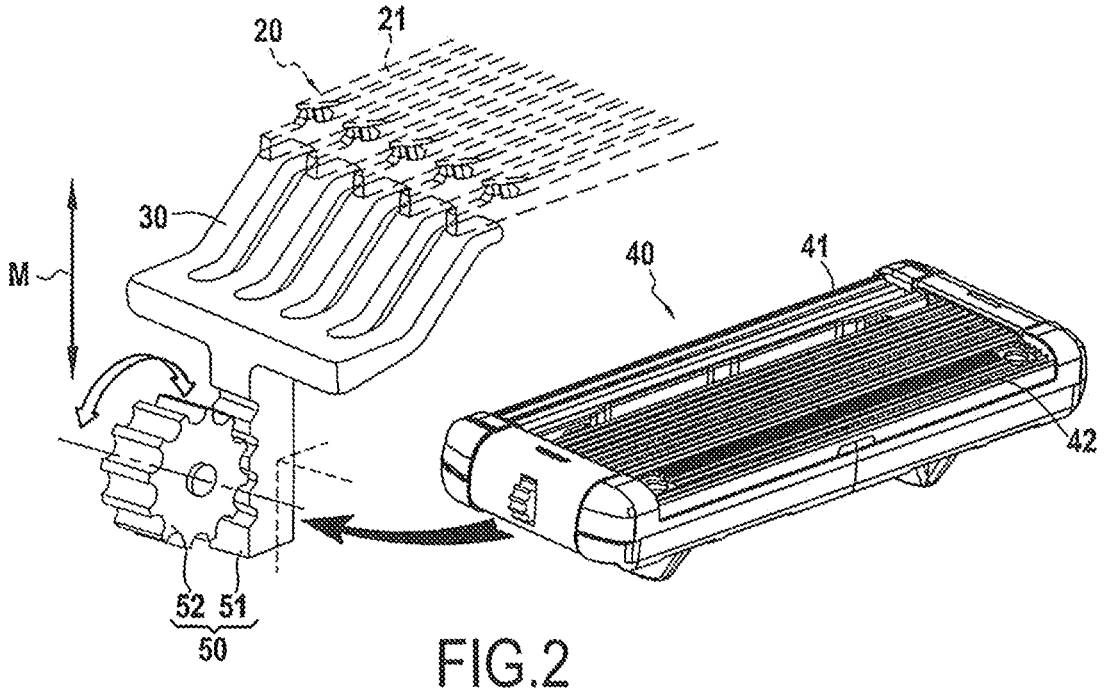
FIG. 2 is a partial, exploded perspective view of a shaving blade assembly according to another example.

Alternatively, however, as illustrated in FIG. 2, the pinions 52 may be at least partially exposed to allow its direct actuation as a dial wheel. Like the dial wheels in FIG. 1, each pinion 52 may then comprise indices, for instance color-coded and/or numbered indices, to indicate the position of the corresponding rack-and-pinion mechanism 50. When the rack-and-pinion mechanisms 50 are not coupled, as illustrated in FIG. 2, these indices may help the user to set both rack-and-pinion mechanisms 50 in the same position. The remaining elements illustrated in FIG. 2 are analogous to those in FIG. 1, and accordingly receive the same reference signs.

In order to hold the position of the rack 51 in the first axis M, in a releasable manner, the shaving blade assembly 10 may further comprise a detent mechanism 70, including for example a protrusion 71 in a first surface resiliently loaded to engage a corresponding recess 72 in a second surface facing the first surface. If the second surface presents a plurality of such recesses 72, the detent mechanism 70 may be suitable to releasably hold each blade 20 in a plurality of different positions in the first direction. This detent mechanism 70 may be arranged in several different, alternative positions in the shaving blade assembly 10.

According to a first possible arrangement, illustrated by FIG. 1, the detent mechanism 70 may be formed in the guide 60. More specifically, in the illustrated embodiment, the protrusion 71 may be formed on the guiding surface 62 and a plurality of corresponding recesses 72 may be formed along the rear surface 61 of the rack 51, although it can also be envisaged to invert this arrangement. A resilient load may be exerted on the rack 51 by a slight radial deformation of the pinion 52 and/or flexing of the rotary shaft 53, so as to both ensure continuous engagement of the pinion 52 with the rack 51 and of the surfaces 61, 62 of the guide 60 against each other, while urging the protrusion 71 into each corresponding recess 72 to resiliently and releasably hold a position of the resilient element 30, and thus the blades 20, with respect to the housing 40. This arrangement thus ensures precision in actuation, guidance and position-holding of the blades 20 along the first axis M.

Figure 3:
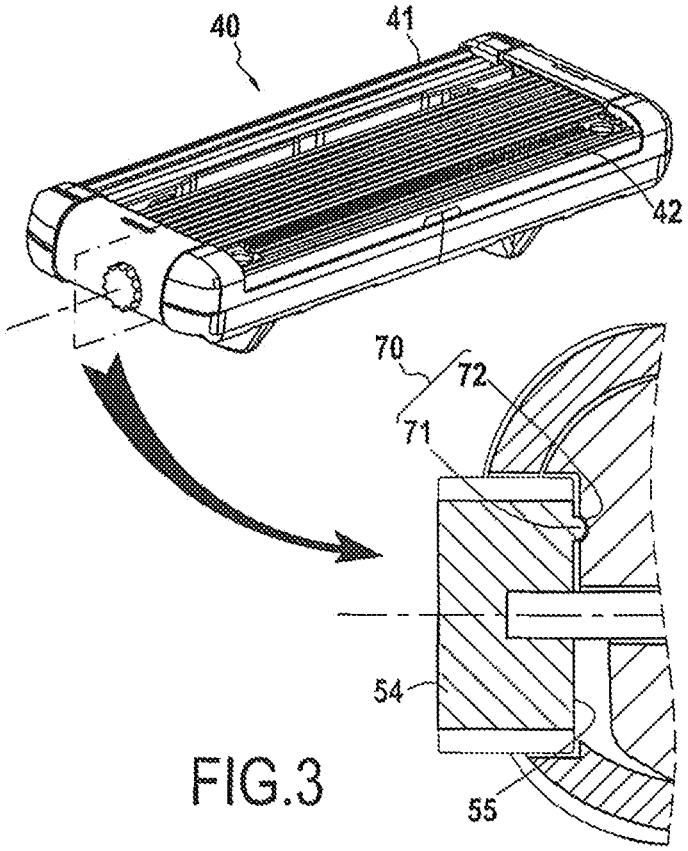
FIG. 3 is a transversal cross section of a shaving blade assembly according to a still further example.

According to a second, alternative arrangement, illustrated by FIG. 3, the protrusion 71 may be formed on a surface 55 of the dial wheel 54 and a plurality of corresponding recesses 72 may be formed on a surface 41 of the housing 40, opposite to the surface 55 of the dial wheel 54. However, this arrangement may also be inverted or adapted to the pinion 52 rather than the dial wheel 54. In this particular arrangement, the recesses 72 may be aligned along a circular path, as shown, so that the protrusion 71 will travel from one recess 72 to the next adjacent recess 72 as the dial wheel 54 rotates. An axial tension on rotatable shaft 53 can provide a resilient load to urge the protrusion 71 into each recess 72 to resiliently and releasably hold a position of the resilient element 30, and thus the blades 20, with respect to the housing 40.

Figure 4:
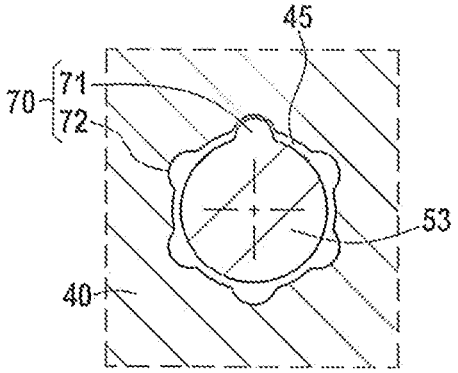
FIG. 4 is a detail view of a shaving blade assembly according to yet another example.

According to yet another alternative arrangement, illustrated by FIG. 4, the protrusion 71 may be formed on an outer surface of the rotatable shaft 53 and the corresponding recesses 72 may be formed in an inner periphery of an orifice 45 in the housing 40, bearing the rotatable shaft 53 at the axial position where the protrusion 71 is located. As in the previous examples, this arrangement may also be inverted, so that the protrusion 71 is located in the inner periphery of orifice 45 and the recesses 72 on the outer surface of the rotatable shaft 53. In either case, a slight press fit of the rotatable shaft 53 within the orifice 45 may ensure that the protrusion 71 is resiliently urged into each recess 72.

In each of these embodiments, as a further safety measure, the detent mechanism 70 may be configured so that an external force, on the at least one blade 20, perpendicularly to the shaving plane S, exceeding a threshold $F_{max}$, may release the detent mechanism 70 from the position it holds, and actuate a movement of the at least one blade 20 in the second direction along the first axis M into the housing 40 at least to the next holding position of the detent mechanism 70. The force pressing against the blade 20 perpendicularly to the shaving plane S during shaving typically ranges between 0.1 and 0.7 N, this threshold $F_{max}$ may be 0.7 N.

In some examples, the shaving blade assembly may comprise a brake mechanism for frictionally holding the rack in at least one position along the first direction instead of the detent mechanism. The brake mechanism may also be arranged between a housing and the rack or pinion of the first rack-and-pinion mechanism, and in particular between the housing and a rotatable shaft coupled in rotation with the pinion.

For example, alternatively to a detent mechanism, the shaving blade assembly 10 may comprise a brake mechanism to frictionally hold the resilient element 30, and thus each blade 20, with respect to the housing 40, against movement along the first axis M. For this purpose, the brake mechanism may include any frictional means interposed between the housing 40 and the rack 51 or pinion 52 of the first or second rack-and-pinion mechanisms, and in particular between the housing 40 and a rotatable shaft 53 coupled in rotation with the pinion 52.

The brake mechanism may include mating textured surfaces, but is not necessarily limited to such frictional means. For example, the brake mechanism may be formed in the guide 60, wherein the friction coefficient and pressure between the guiding surface 62 and the rear surface 61 of the rack 51 may be selected to oppose a frictional resistance to movement along the first axis M. This brake mechanism offers a possibility of gradual adjustment over a range of minutely different positions.

Figure 5:
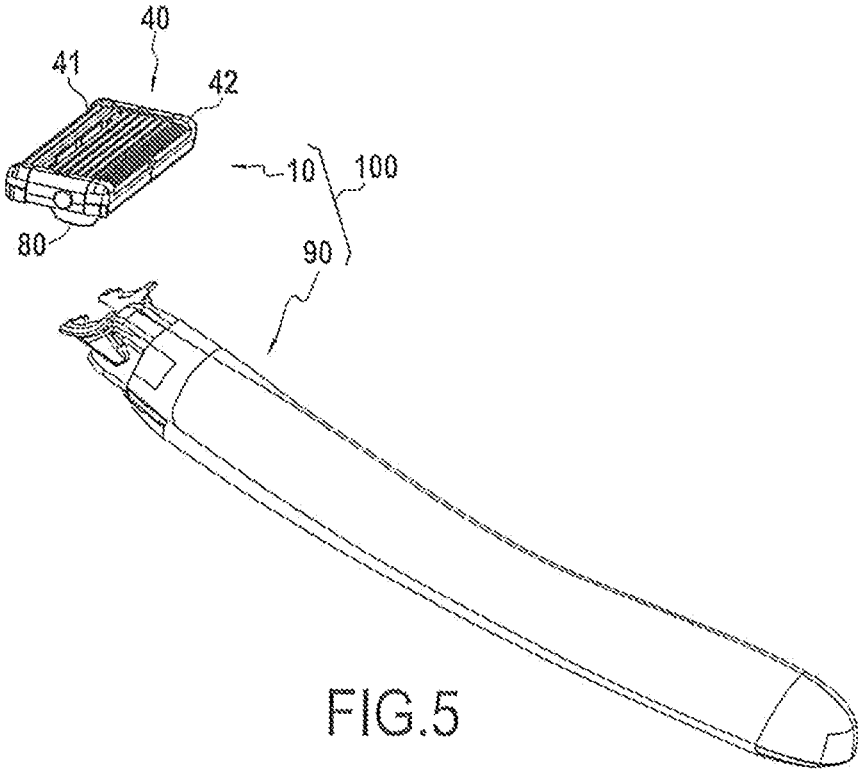
FIG. 5 is a perspective view of a razor with an interchangeable cartridge comprising a shaving blade assembly.
Figure 6:
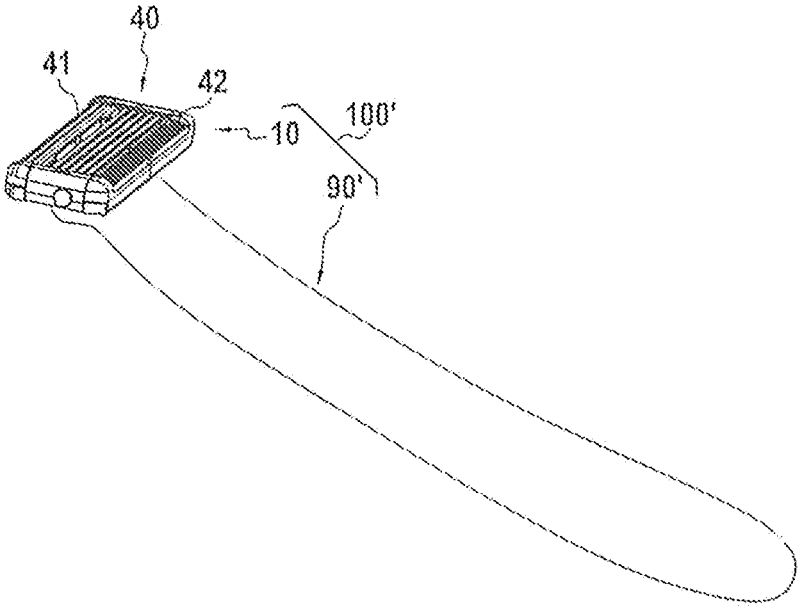
FIG. 6 is a perspective view of a disposable razor comprising a shaving blade assembly integrally formed with a handle.

As illustrated on FIG. 5, the shaving blade assembly 10 may be formed as an exchangeable blade cartridge further comprising a releasable connector 80 for releasably connecting the shaving blade assembly 10 to a razor handle 90 to form a razor 100. Alternatively, however, as illustrated on FIG. 6, the shaving blade assembly 10 may be integrated in a disposable razor 100' with an integrally formed razor handle 90'. In either case, to provide better contact between the blades 20 and the skin, the razor 100 or disposable razor 100' may be articulated, around at least one axis, between the housing 40 and the razor handle 90, 90'.

In operation of any one of the illustrated examples, blade exposure may be adjusted through rotation of the pinion 52 of the at least one rack-and-pinion mechanism 50 actuating a motion of the rack 51 along the first axis M, relative to the housing 40 and its blade retainers 44, which will thus increase or decrease the pressure exerted on each blade 20 by the corresponding resilient element 30 coupled to the rack 51. This may not only correspondingly decrease or increase the pliancy of the blade 20 against pressure exerted against the cutting edges 21 during shaving, but also, if the blade retainers 44 are themselves resilient, may move the plane C defined by the cutting edges 21 of the blades 20 to increase or decrease the blade exposure.

Figure 7:
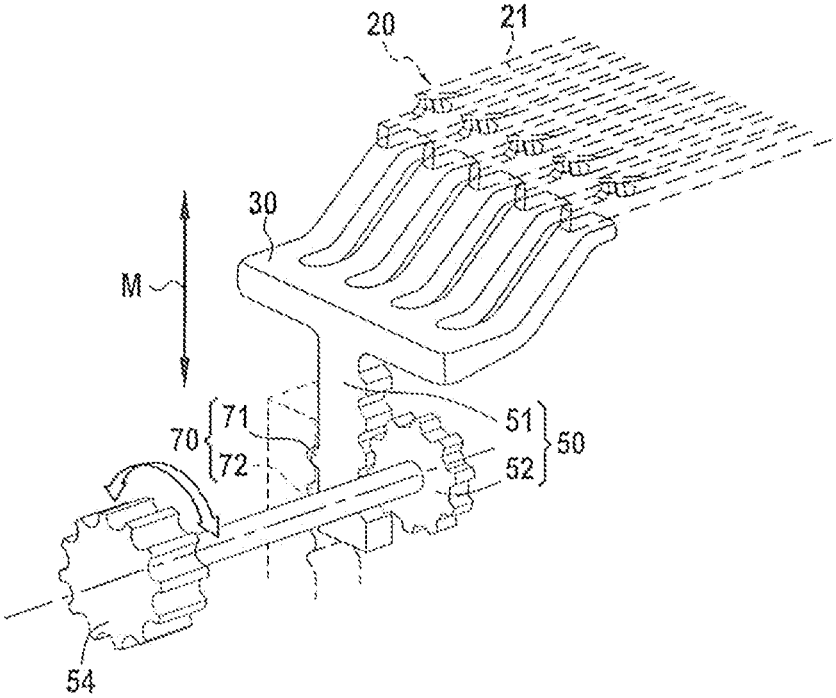
FIG. 7 illustrates the movement of a rack-and-pinion mechanism in the shaving blade assembly of FIG. 1.

As shown in FIG. 7, with respect to the embodiment illustrated on FIG. 1, starting from an initial position, a rotation of the dial wheel 54 may drive the pinion 52 through the rotatable shaft 53, and this rotation of the pinion 52, engaging the rack 51, may in turn drive the resilient elements 30 along the first axis M with respect to the housing 40. This movement may go through one or several intermediate positions until a final position. If the resilient blade retainers 44 act as counter-springs against the resilient elements 30, this movement of the rack 51 carrying the resilient elements 30 may displace the plane C defined by the cutting edges 21 of the blades 20 with respect to the shaving plane S to obtain a more or less bold shave. If the shaving blade assembly 10 comprises a detent mechanism 70 as shown in any one of FIGS. 1 to 4, the initial position, final position and any intermediary position may correspond to the engagement of the protrusion 71 with a corresponding recess 72, so that the rack-and-pinion mechanism 50 may be releasably held at each one of these positions, and also so that the user may be able to accurately feel the travel of the rack 51 within the housing 40 through the clicking of the protrusion into and out of successive recesses 72 at intermediary positions. Alternatively, a brake mechanism that may simply be provided by the friction between moving parts in the shaving blade assembly 10 may also frictionally hold the blade retainer 30 at the initial and/or final position. In either case, the travel of the rack 51, with respect to the housing 40, along the first axis M may be limited by end stops 63, 64 in either direction.

Those skilled in the art will recognize that the present disclosure may be manifested in a variety of forms other than the specific examples described and contemplated herein. Accordingly, departure in form and detail may be made without departing from the scope of a fair reading of the appended claims.

The invention claimed is:

1. A shaving blade assembly comprising:

a blade;

one or more blade retainers;

a first resilient element pressing the blade against the one or more blade retainers in a first direction along a first axis orthogonal to a cutting edge of the blade; and a first rack-and-pinion mechanism comprising a rack operationally coupled to the first resilient element and a pinion for actuating a motion of the rack along the first axis.

2. The shaving blade assembly of claim 1, wherein the one or more blade retainers are resilient so as to act as counter-springs to the first resilient element.

3. The shaving blade assembly of claim 1, wherein the first rack-and-pinion mechanism further comprises an end stop for limiting travel of the rack in the first direction along the first axis.

4. The shaving blade assembly of claim 1, further comprising a detent mechanism for releasably holding the rack in one or more positions along the first axis.

5. The shaving blade assembly of claim 4, further comprising a housing, wherein the detent mechanism is arranged between the housing and the rack of the first rack-and-pinion mechanism.

6. The shaving blade assembly of claim 4, further comprising a housing, wherein the detent mechanism is arranged between the housing and the pinion of the first rack-and-pinion mechanism.

7. The shaving blade assembly of claim 6, wherein the pinion is rotatably coupled with a rotatable shaft and the detent mechanism is arranged between the housing and the rotatable shaft.

8. The shaving blade assembly of claim 1, wherein the first resilient element and the rack of the first rack-and-pinion mechanism are integrally formed as a monoblock part.

9. The shaving blade assembly of claim 1, wherein the cutting edge of the blade extends from a first end of the blade to a second end of the blade, the first resilient element being adjacent to the first end of the blade, and the shaving blade assembly further comprising a second resilient element, adjacent to the second end of the blade, wherein the second resilient element also presses the blade against the one or more blade retainers in the first direction along the first axis, and a second rack-and-pinion mechanism comprising a rack operationally coupled to the second resilient element and a pinion to actuate a motion of the rack of the second rack-and-pinion mechanism along the first axis.

10. The shaving blade assembly of claim 9, wherein the pinion of the first rack-and-pinion mechanism and the pinion of the second rack-and-pinion mechanism are rotatably coupled by a rotatable shaft.

11. The shaving blade assembly of claim 1, wherein the blade is one of a plurality of parallel blades of the shaving blade assembly, and the first axis is substantially perpendicular to a plane defined by cutting edges of the plurality of blades.

12. The shaving blade assembly of claim 1, further comprising a releasable connector for connecting the shaving blade assembly to a razor handle.

13. A razor comprising the shaving blade assembly according to claim 12 and a razor handle connected to the releasable connector of the shaving blade assembly.

14. A disposable razor comprising the shaving blade assembly according to claim 1 and an integrally formed razor handle.

15. A method for adjusting pressure on a blade of a shaving blade assembly in a first direction along a first axis orthogonal to a cutting edge of the blade, the method comprising a step of rotating a pinion of a first rack-and-pinion mechanism to actuate a motion, along the first axis, of a rack of the first rack-and-pinion mechanism, wherein rack is operationally coupled to a first resilient element that presses the blade against one or more blade retainers of the shaving blade assembly in the first direction along the first axis by rotating the pinion to actuate the motion of the rack so that the pressure exerted by the first resilient element on the blade against the one or more blade retainers is adjusted.

* * * * *